United States Patent [19]

Just

[11] Patent Number: 4,908,067

[45] Date of Patent: Mar. 13, 1990

[54] HYDROLYSIS PROCESS

[75] Inventor: Jack T. H. Just, 13 Holland Street, Rotorua, New Zealand

[73] Assignee: Jack T. H. Just, Rotorua, New Zealand

[21] Appl. No.: 147,118

[22] Filed: Jan. 21, 1988

Related U.S. Application Data

[63] Continuation-in-part of Ser. No. 54,031, May 21, 1987, abandoned, which is a continuation of Ser. No. 774,561, Sep. 10, 1985, abandoned.

[30] Foreign Application Priority Data

Sep. 13, 1984 [NZ] New Zealand ..... 209527

[51] Int. Cl.[4] ..... C13K 1/02

[52] U.S. Cl. ..... 127/37; 127/1; 127/43; 127/44; 530/500

[58] Field of Search ..... 127/37, 1, 43, 45, 44, 127/53, 55; 530/500

[56] References Cited

U.S. PATENT DOCUMENTS

| | | | |
|---|---|---|---|
| 1,056,161 | 3/1913 | Gallagher | 127/37 |
| 2,681,871 | 6/1954 | Wallace | 127/37 |
| 2,739,086 | 3/1956 | Wallace et al. | 127/37 |
| 4,023,982 | 5/1977 | Knauth | 127/1 |
| 4,168,988 | 9/1979 | Riehm et al. | 127/37 |
| 4,370,172 | 1/1983 | Gueissaz | 127/1 |
| 4,427,453 | 1/1984 | Reitter | 127/1 |
| 4,432,805 | 2/1984 | Nuuttila et al. | 127/37 |
| 4,461,648 | 7/1984 | Foody | 127/37 |
| 4,468,256 | 8/1984 | Hinger | 127/37 |
| 4,556,430 | 12/1985 | Converse et al. | 127/36 |

OTHER PUBLICATIONS

Olsen, "Unit Processes and Principles of Chemical Engineering", D. van Nostrand Comp. Inc., pp. 1-3, 1932.

*Primary Examiner*—H. M. S. Sneed
*Assistant Examiner*—Chung K. Pak
*Attorney, Agent, or Firm*—Dressler, Goldsmith, Shore, Sutker & Milnamow, Ltd.

[57] ABSTRACT

A continuous hydrolysis process for the hydrolysis of wood and wood derived products into sugars and other products, wherein woodchip or other feedstock is formed into a slurry which is acidified, pressurized and heated before being hydrolyzed in reactors J. Three heat exchangers L1, L2 and L3 form a closed circuit in which exchanger L2 recovers heat from the slurry, L1 returns heat to the slurry and L3 makes up lost heat. The slurry is cooled before pressure reduction by pressure reducing means N and separation of the solids and liquid. The cooling prevents flashing to steam of part of the liquid in the slurry so that the process is single phase where generation of steam is avoided. After separation the solids can proceed to further processing or to discharge as lignin as indicated by arrow B. The liquid can proceed to further processing or discharge as indicated by arrow D.

4 Claims, 3 Drawing Sheets

HYDROLYSIS PROCESS

BACKGROUND OF THE INVENTION

This is a continuation-in-part of application Ser. No. 07/054,031 filed 05/21/87, now abandoned, which is a continuation of application Ser. No. 06/774,561 filed 09/10/85, abandoned.

This invention relates to improvements in and relating to an hydrolysis process and in particular to the hydrolsis of wood and wood derived products, in particular the conversion of cellulose and hemicellulose into glucose, xylose, and other 5 and 6 carbon sugars.

There is a growing interest throughout the world in the utilisation of cellulose material as a feedstock for the manufacture of chemical and fuels. Woodchips, shavings, waste, waste-paper or other residues, offer a useful, but not the only, raw material for this purpose.

The hydrolysis of wood and wood derived products has been proposed by various routes, including the use of acids and enzymes. The process of hydrolysing involves breaking down the carbohydrate molecule, either cellulose or hemicellulose, into simple sugars. The process which has further evolved in New Zealand over recent years is the hydrolysis of wood using a high temperature, weak, sulphuric acid solution and a plant based on this process has been built in New Zealand under my direction.

In this process a hot, weak, acid solution is percolated through wood chips in a reactor vessel when the carbohydrate breaks down to simple sugars. The process recycles; the fresh sugar-free solution at highest temperature is first percolated through one reactor with wood previously hydrolysed to remove the hemicellulose; when under set conditions, hydrolysis of the remaining cellulose naturally occurs. The resulting sugar is discharged with the acid solution from this first vessel into a second vessel then containing fresh feedstock. The resulting acid solution, with sugar from both cellulose and hemicellulose hydrolysis, is then discharged and neutralised, this solution being called the hydrolysate.

One possible processing route for this hydrolysate is to innoculate it with a suitable yeast able to ferment the sugars in solution into ethanol and carbon dioxide; then to concentrate the ethanol for sale. The hexose sugars are fermented; however, the pentose sugars may not be used so easily and pass through the system as a pollutant in the effluent. One possible processing route for these pentose sugars is to digest them thereby significantly cleaning the effluent before discharge and using the methane produced from the digestion as an energy source for the total process, i.e. hydrolysis, fermentation and distillation.

The hydrolysis process is not new having evolved prior to World War 1, the first plant being built in South Carolina, United States of America. The Germans and Russians acquired the technology in the 1920's and 1930's and a higher yielding process named the Scholer process was developed in Germany. Further development of the process occurred at Forest Products Laboratory, Madison, Wisconsin, United States of America and Eugene, Oregon, United States of America, in the 1940's and the Madison process was reassessed in the late 1970's by the New Zealand Forest Research Institute at Rotorua with a pilot plant being commissioned in 1979.

The New Zealand Forest Research Institute process is described in the Forest Research Institute publication No. 69,1979, "What's New in Forest Research", and is shown in FIG. 1. The description in this publication is as follows:

"Hydrolysis: Water, with sulphuric acid as a catalyst, is used to break down wood cellulose into its component sugars, hexose and pentose. Wet sawdust or wood chips are loaded and sealed into a reactor vessel. Water is then superheated to 170–200° C., sulphuric acid added and the solution percolated through the wood for about 3 hours. During this time the sugar solution is continually drawn off. An insoluble residue, lignin, remains in the reactor and is removed at the end of percolation. The sugar solution is cooled rapidly by flashing it to lower pressure, this releases the volatile materials, furfurol and methanol, along with steam and causes tars to be precipitated to the bottom of the tank. The remaining sugar liquid is further cooled to 30° C. The sulfuric acid is now removed by adding lime to the solution. The gypsum resulting from this reaction can be filtered off.

The process described above is a batch process and reconfirms work done at the Forest Products Laboratory in the 1940's (see Ind. & Eng. Chem. Vol. 38 No. 9, p. 890 (1946)). The alternative to a batch process for acid catalysed cellulose hydrolysis is by a continuous process. While in a batch process a discrete quantity of feedstock has an acid solution percolated through it, with the remaining solids then discharged, in contrast, in a continuous process the feedstock is fed continuously to a processing means, together with an acid solution and the resulting solid (lignin) and solution (hydrolysate) is discharged continuously.

Various researchers have in recent times developed methods for achieving this continuous hydrolysis. Notable is work done by Grethlein et al at Dartmouth College, New Hampshire, U.S.A. (see U.S. Pat. No. 4,237,226) and by Rugg et al at New York University (see U.S. Pat. No. 4,316,747). Other research has been conducted by the American Can Company (see Church et al U.S. Pat. No. 4,201,596).

In Olsen, "Unit Processes and Principles of Chemical Engineering" D Van Nostrand Company Inc 1932 it is outlined that to maximize heat using heat exchange means in a chemical process is well known. Olsen doe not provide a proper starting point as it does not disclose mention, or even hint of a process for the continuous hydrolysis of wood or wood derivatives which is single phase with co-current process flow and having a closed loop system of heat exchangers with subsequent heat regeneration functioning to substantially minimize the heat requirements of the process.

U.S. Patent Specification No. 4468256 to Hinger describes an apparatus and process for the hydrolysis of cellulose. The apparatus comprises a tubular reactor having an endless piston chamber into which raw material impregnated with acid is conveyed. High pressure saturated steam is blown into the piston chamber. The hydrolyzed material is subsequently discharged and the glucose formed is extracted by means of an alkaline hot wash water. The process and apparatus has no relevance to the present invention which is a single phase process utilizing indirect heating by a closed loop system of heat exchangers which supply and recapture heat functioning to substantially reduce the heat energy requirements.

United States Patent Specification No. 4461648 to Foody describes a method whereby materials are steam-cooked, then rapidly depressurized incorporating a venting sequence to remove volatiles from their reactor. The process described is a batch process and not a continuous operation as described in the present invention. The present invention is distinguished from Foody in that it provides a coninuous single phase process with a closed loop system of heat exchangers supplying and recapturing heat functioning to substantially reduce the heat energy requirements.

The invention described in U.S. Patent Specification No. 2739086 to Wallace et al provides a two-stage continuous process for producing both furfural and hexoses from cellulosic materials, wherein the cellulosic material is first treated with a material in the vapor state and secondly with a material in liquid state, thus first removing the volatile products formed and then removing soluble materials. The apparatus and method described is substantially similar to that of L. C. Wallace U.S. Pat. No. 2,681,871 in that the contacting material, either vapor, or liquid, is passed continuously in a countercurrent fashion.

More specifically, the Wallace specification describes a pre-acidified cellulosic material passing continuously through a first stage pressurized zone in contact with countercurrently flowing or with countercurrently flowing steam with acidic or neutral gases and the residual cellulosic material is passed through a second stage pressurized zone in contact with a countercurrently flowing hydrolyzing solution. The first stage functions to remove the furfural and an atmosphere of vapor and the second stage functioning to remove the sugar in an aqueous medium. This differs substantially from the present invention in that as described herein the present invention provides a reactor with individual co-current-/solid-liquid streams. The process of the present invention is single phase with no generation of vapor but with a closed loop system of heat exchangers with substantial heat regeneration.

U.S. Patent Specification No. 4,427,453 to Reitter describes a process and apparatus wherein biomass is fed into a high pressure reaction vessel. The hydrolysis takes place in the vapor phase in a continuous horizontal tube digestor. The hydrolysate is separated from the reaction mixture following a sudden pressure release causing the liquid to be blown off. In contrast, the slurry of the present invention after heating to hydrolyzing temperature, and subsequent hydrolysis, is then cooled and passed to a pressure reducing means. A consequence of the removal of heat of the slurry is that as the discharge from high pressure to low pressure takes place, the generation of vapor is avoided. Thus, the process of the present invention in contrast with Reitter is a single phase process where the generation of vapor is avoided. The purpose of using a single phase process is to minimize heat loss. The present invention is centered around hydrolyzing cellulose materials in the most time and cost efficient system possible. This is done by having a single phase process with a closed loop system of heat exchangers which supply and subsequently regenerate heat which results in the heat energy requirements of the present invention being perhaps 10–20% of that required for other continuous processes and perhaps 5% of that required for batch percolation processes.

The process of U.S. Patent Specification No. 4,556,430 to Converse et al employs a continuous plug-flow reactor with rapid heating by injection of steam and the use of a suitable hydrocarbon. The process is not the same as the present invention which is a single phase process where the generation of vapor is avoided. The specification describes flash-cooling while the slurry of the present invention is cooled before the pressure reducing means thus avoiding the generation of vapor. The specification does not describe the inventive features of the present invention of a single phase process with a closed loop system of heat exchangers supplying and recapturing heat functioning to substantially minimize the heat energy requirements of the present invention.

The apparatus described in Wallace '871 consists of a reaction chamber having a hydrolyzing solution continually introduced at the bottom causing said solution to flow in a direction countercurrent to the flow of the cellulosic material. The volatile materials and liquor are continuously drawn off adjacent the top of the reaction chamber while the lignin is continuously discharged at the bottom of the reaction chamber. The heat needed for hydrolysis is provided by direct steam injection into the reaction vessel at the bottom end with solid/liquid separation being effected within the reactor vessel at high pressure and hydrolysate being removed at high temperatures. Comparing the apparatus and method described with the present invention, the present invention is in the first instance comprised of a reactor with co-current process flow; that is, cellulose vertically down and hydrolyzing solution vertically up, whereas the present invention uses a co-current process flow within each individual reactor. Also, as mentioned, the present invention utilizes a closed loop system of heat exchangers with subsequent heat regeneration substantially minimizing the heat requirements of the present invention. The specification is a two-phase process with the generation of vapor and utilizes direct steam injection with no discussion of heat regeneration.

U.S. Patent Specification No. 1,056,161 to Gallagher discusses cooking of wood at high temperatures with a hydrolyzing agent utilizing direct high pressure steam injection. The described process is a batch process very different to the present invention with no discussion of the possibility of a continuous operation or the means by which the chemical process is achieved. This specification does not describe a single phase process with a closed loop system of heat exchangers. There is in fact no discussion of heat regeneration. The process is a two phase process producing vapor and would in consequence consume far more energy than would the present invention.

An object of the present invention is to overcome, or at least reduce, the disadvantages in wood hydrolysis batch processes and apparatus available to the present time for this purpose. In particular to provide an improved wood hydrolysis process operating as a continuous process.

Further objects of the present invention will become apparent from the following description.

SUMMARY OF THE INVENTION

According to one aspect of the present invention there is thus provided a process for the continuous hydrolysis of wood and wood derived products, comprising:

(I) continuously feeding a wood and wood derived products as a feedstock to a receiving means of a main process line;

(II) injecting a weak acid solution into the receiving means to presoak the feedstock;

(III) continuously feeding the feedstock by a conveying means from the receiving means to a first pressurising pump which feeds the feedstock under pressure toward a first reactor loop of the main process line;

(IV) creating in the main process line at an injection point a feedstock slurry by injecting water or a liquid phase into the process line;

(V) continuously feeding the slurry under pressure into and through one or more reactor loops;

(VI) heating each reactor loop with a first heat exchanger to raise the temperature of the pressurised slurry therein to a temperature sufficient for hydrolysis of the slurry to occur;

(VII) maintaining with its said first heat exchanger the temperature of the slurry in the process line for sufficient time for leaching of the slurry to occur;

(VIII) cooling the pressurised slurry in each reactor loop with a second heat exchanger to avoid the generation of vapour and ensure the process is single phase;

(IX) recovering heat from said second heat exchanger and utilizing the heat recovered to supply at least part of the heat requirements of said first heat exchanger;

(X) reducing with pressure reduction apparatus at an outlet of each reactor loop the pressure of the cooled slurry therein while maintaining the pressure in the reactor loop while the slurry is continuously discharged;

(XI) separating the solid and liquid portions of the slurry using a separator;

(XII) discharging the solid portion which is lignin or passing it to the next reactor loop of the main process line; and (XIII) discharging the liquid portion which is sugar rich acid-hydrolysate or injecting the liquid portion to the preceding reactor loop of the main process line.

According to a further aspect of this invention there is provided a process for the continuous conversion of cellulose and starch material, comprising:

(I) continuously feeding a cellulose or starch material as a feedstock to a receiving means of a main process line;

(II) injecting a weak acid solution into the receiving means to presoak the feedstock;

(III) continuously feeding the feedstock by a conveying means from the receiving means to a first pressurising pump which feeds the feedstock under pressure toward a first reactor loop of the main process line;

(IV) creating in the main process line at an injection point a feedstock slurry by injecting water or a liquid phase into the process line;

(V) continuously feeding the slurry under pressure into and through one or more reactor loops;

(VI) heating each reactor loop with a first heat exchanger to raise the temperature of the pressurised slurry therein to a temperature sufficient for hydrolysis of the slurry to occur;

(VII) maintaining with its said first heat exchanger the temperature of the slurry in the process line for sufficient time to maximise sugar production and leaching from the solid;

(VIII) cooling the pressurised slurry in each reactor loop with a second heat exchanger to avoid the generation of vapour and ensure the process is single phase;

(IX) recovering heat from said second heat exchanger and utilizing the heat recovered to supply at least part of the heat requirements of said first heat exchanger;

(X) reducing with pressure reduction apparatus at an outlet of each reactor loop the pressure of the cooled slurry therein while maintaining the pressure in the reactor loop while the slurry is continuously discharged;

(XI) separating the solid and liquid portions of the slurry using a separator;

(XII) discharging the solid portion which is lignin or passing it to the next reactor loop of the main process line; and (XIII) discharging the liquid portion which is sugar rich acid-hydrolysate or injecting the liquid portion to the preceding reactor loop of the main process line.

According to a still further aspect of the invention there is provided an apparatus and/or method for the continuous hydrolysis of wood or wood derived products as shown in the accompanying drawings.

Further aspects of this invention which should be considered in all its novel aspects will become apparent from the following description given by way of example of one possible embodiment of the invention and in which reference is made to the accompanying drawings.

DETAILED DESCRIPTION OF ILLUSTRATION EMBODIMENT

Figure 1:
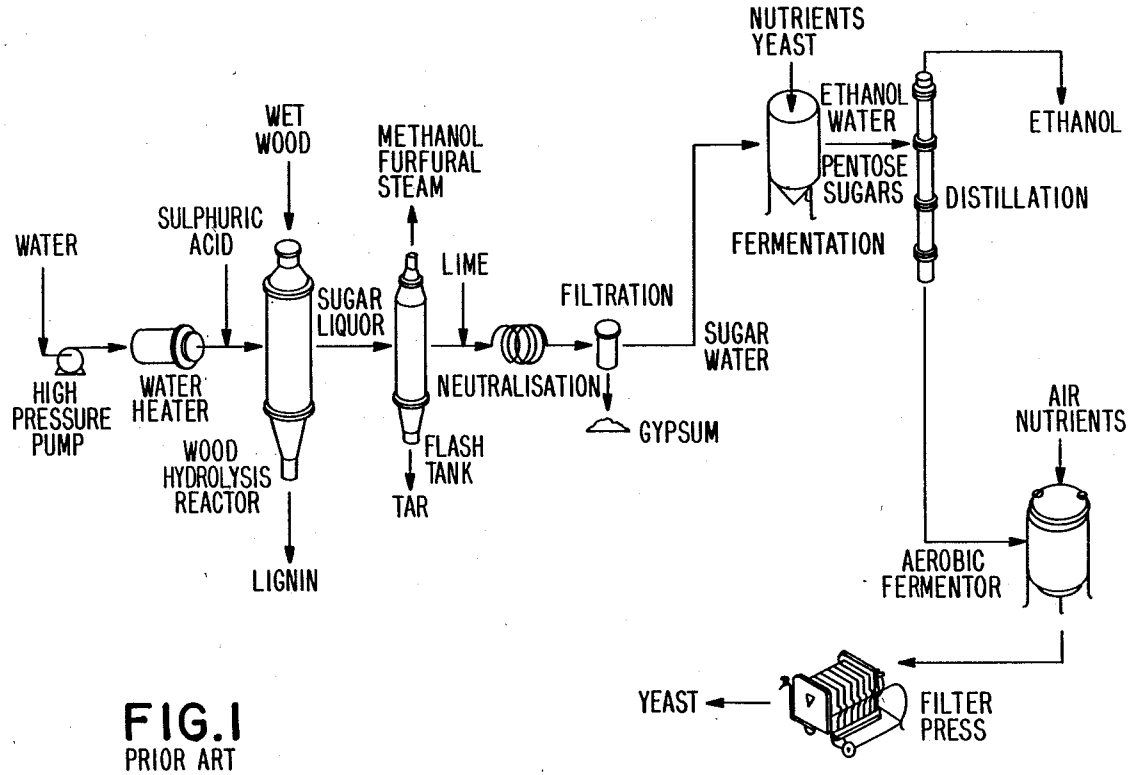
FIG. 1 PRIOR ART
FIG. 1 is a schematic illustration of the prior art hydrolysis process as carried out by the New Zealand Forest Research Institute of Rotorua, New Zealand.
Figures 2, 3:
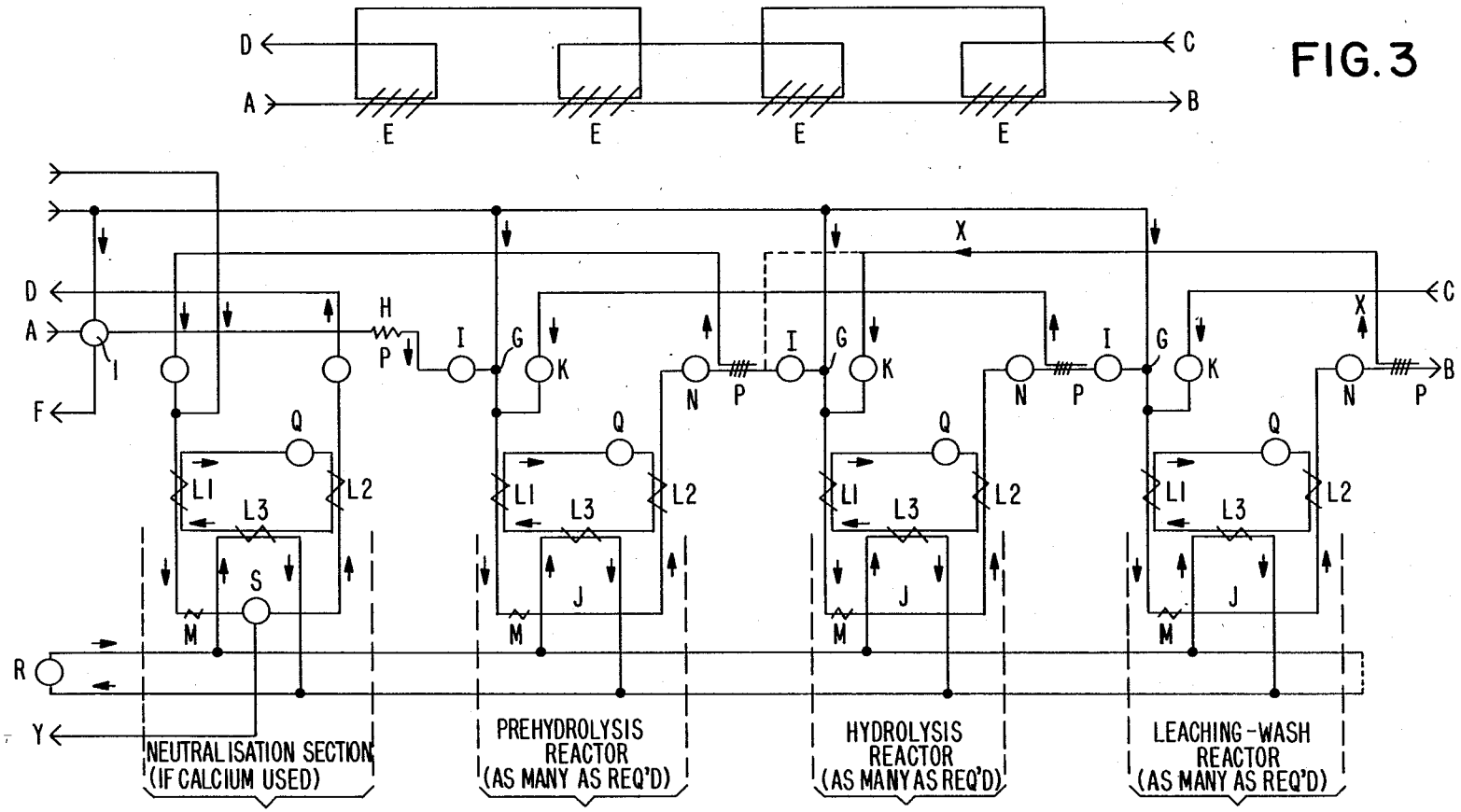
FIG. 2 is a schematic illustration of an hydrolysis process and apparatus therefor according to one possible embodiment of the invention and wherein in a continuous hydrolysis process feedstock such as woodchip and water can be introduced with hydrolysate and lignin being continuously produced.
FIG. 3 is a very diagrammatic and simplified illustration of the process of FIG. 2.
Figure 4:
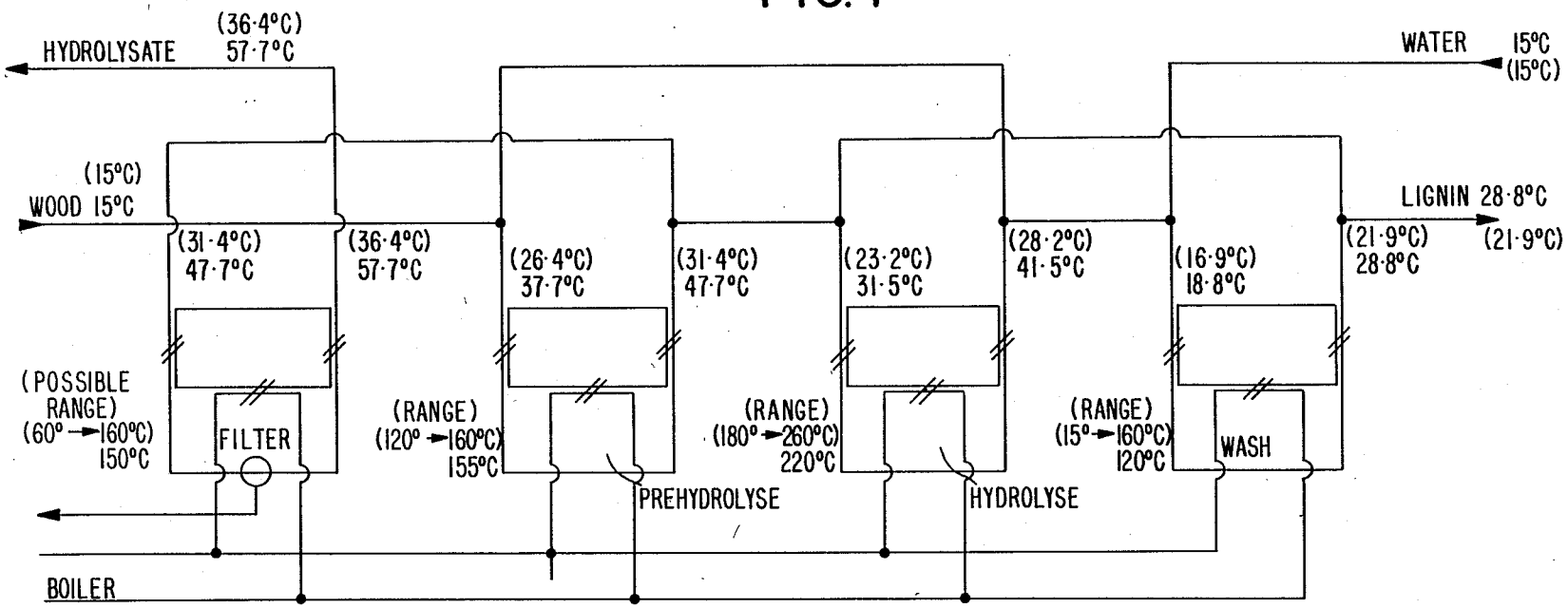
FIG. 4 is a diagrammatic illustration of the process of FIG. 2 with two sets of possible process flow temperatures included.

The process according to the embodiment of the invention shown in FIGS. 2, 3 and 4 is seen to have some elements of a tubular reactor (see Perry Chilton—5th Edition—FIG. 4.4) and a continuous countercurrent leaching process (see Perry Chilton, page 19.54) with or without line mixers (Perry Chilton, FIG. 19.39).

Referring firstly to FIG. 3, this shows very diagrammatically the simplified flow pattern of a continuous countercurrent leaching tubular reactor according to a preferred embodiment of the invention.

Woodchip or other wood derived feedstock is fed into the process at arrow A and a main process flow line is then shown by the solid line extending to the output of lignin indicated by arrow B. Also on the right hand side of the schematic diagram in FIG. 3, water is introduced as indicated by arrow C and at the areas indicated by arrow E will counteract with the main process flow line having an output of hydrolysate as indicated by arrow D at the left hand side of the schematic diagram.

As will be immediately apparent from FIG. 3 while in toto the respective solid and liquid flows are countercurrent, within the reaction loops the solid and liquid flows are co-current in direction.

Thus, the hydrolysis process of the present invention provides a continuous hydrolysis process which has both an overall countercurrent flow of liquids and solids but an integral co-current flow of the liquids and solids as part of the process.

Turning now to FIG. 2 of the accompanying drawings, feedstock such as wood or cellulose/starch is fed in a direction indicated by arrow A into a feedstock acid presoak container 1 from which acid may be drained or recycled as indicated by arrow F. The container 1 may be any suitable type but could for example be merely a walled storage area. This receives the feedstock A which may suitably have been previously screened. In the container 1 a weak acid solution will be sprayed over the feedstock and allowed to soak through it for a predetermined time. Any excess solution will be drained away as mentioned previously for re-use along arrow F.

Alternatively, the feedstock may be wetted with water only and an acid solution may be pumped under pressure into the main process line at either or all of the possible alternative acid injection points indicated by G in FIG. 2.

The saturated feedstock is then conveyed by a suitable conveying means H, for example a screw-feed conveyor, to a main pump I, being, in the process shown, one of several main feed and pressurising pumps used in the system.

The conveyor H and the pump I may suitably be of stainless steel or some other non-corrosive or non-reacting material.

The main pump I will force the feedstock into the main tubular reactor J raising the pressure in the reactor J well above the later saturation pressure. The reactor J, one of several reactors in the process of the embodiment of the invention as shown, will suitably be a pipe made of copper, monel, titanium, hastalloy or other suitable material or coated with such materials or for example a material such as Teflon (registered trade mark).

Counterflowing liquid indicated by arrows X can be injected into the main process pipe using one of a series of fluid injection pumps K, either before a main feed and pressurising pump I, or after it as indicated by the dotted line, the feedstock and the liquid combining to form a slurry.

The slurry passes along the reactor pipe J when it is heated by a first heat exchanger L1 to hydrolysis temperature. The slurry then passes along the reactor pipe J and may usefully be continuously mixed by in-line mixers M. The length of the reactor pipe J will be determined by several factors including temperature, velocity, solid-liquid ratio, and pH of the slurry so that the hydrolysis reaction for a particular part of the process is optimised.

The slurry will then be cooled in heat exchanger L2 and the cooled slurry then passes to a pressure reducing means such as a pump, valve or nozzle or a purpose made device or any combination of these, N. The purpose of the pressure reducing means is to allow the reactor to remain under pressure while continuously discharging slurry. A consequence of the removal of heat before the pressure drop takes place is that as the discharge from high pressure to low pressure takes place no flash steam is generated. Thus, the present process in contrast with prior art proposals is a single phase process where the generation of steam is avoided.

After the pressure reducing means N, the slurry, then at low pressure and temperature passes on to a separating means P which may for example be a filter pipe, filter press, settling container or centrifuge. Once the separation has been effected, the solids can then pass forward to further processing or to discharge as lignin as indicated by arrow B on the right hand side of FIG. 2. The liquid passes backwards to further processing or discharge as hydrolysate as indicated by arrow D on the left hand side of FIG. 2.

The number of stages required to effect an optimum sugar separation will be dictated by several non-linear varying parameters.

As previously mentioned, the flow of liquid and solid material through the flow loops is in a co-current direction. A consequence of this is that as it is a slurry which is passing through the pipes of the reactors clogging as could result from a separated liquid/solid phase process can be avoided.

Also, in these heat exchange loops, the heat exchangers L1, L2 and L3 are joined by pipes and pumps Q to form a closed circuit. Heat given up by heat exchanger L1 to the main flow slurry is recaptured later on at L2 when heat is returned from the slurry to the closed circuit fluid. The recovery or regeneration of this heat will of course reduce heat requirements for the process. Heat lost to the atmosphere or remaining in the slurry after exchanger L2 is made up by heat from the external heat source such as a hot oil heater or boiler R which supplies heated fluid such as hot oil to the heat exchanger L3.

If the sugar rich acid-hydrolysate is to be neutralised using calcium carbonate or calcium hydroxide as a milk and as is illustrated in FIG. 2, then the resulting calcium sulphate with its inverse solubility may preferably be removed at about 150° C. with filter presses or centrifuges and the process flow becomes similar to the hydrolysis flow. As illustrated in the left hand portion of FIG. 2 the filter or centrifuge S may provide an output of calcium sulphate in a direction indicated by arrow Y as a slurry or cake.

The separation of the liquid and solid portions of the slurry as it is continuously fed through the system continues until the continuous cycle has been completed with further hydrolysing, washing and/or neutralising.

The liquid hydrolysate lines and pumps shown in FIG. 2 may suitably be of stainless steel or be of the materials or have the coatings mentioned for use previously in respect of the tubular reactor pipes.

It is thus seen that a continuous process has been achieved by the present invention with the continuous leaching and removal of sugar and lignins.

Additional advantages of the present invention are as follows;

1. very low heat energy requirements perhaps 10 to 20% of that required for other continuous processes and perhaps 5% of that required for batch percolation processes;

2. simplicity of design and construction of the reactor vessels with no moving parts, either valves or pumps, in the high temperature, corrosive zone;

3. single phase flow throughout the system leads to improved heat transfer to the slurry and the elimination of energy losses from flashing to steam of part of the liquid in the slurry;

4. because of the improved heat transfer, larger size particles can be utilised reducing the need for a ground feedstock with its possible degeneration to a mud-like slurry leading to more difficult separation problems;

5. the efficiency of the system allows for a low liquid-solid feed slurry ratio giving high sugar concentrations in the hydrolysate and consequentially lower energy needs.

Referring now to FIG. 4, this shows possible process flow temperatures throughout the process of FIG. 2. Two sets of process temperatures are indicated, both having been derived from computer models. A slurry having a liquid-solid ratio of 6:1 has been assumed and the pressure in the process will always be well above saturation pressure. It is seen that the temperature change across the reactors is 10° C. for one set of process temperatures and 5° C. for the other set. It is emphasised however that the temperatures given are only examples of an infinite set of possible temperature combinations for each of which there will be an optimum and critical design requirement.

Where in the aforegoing description reference has been made to specific components or integers of the invention having known equivalents then such equivalents are herein incorporated as if individually set forth.

Although this invention has been described by way of example and with reference to possible embodiments thereof it is to be understood that modifications or improvements may be made thereto without departing from the scope or spirit of the invention as defined in the appended claims.

I claim:

1. A process for the continuous hydrolysis of wood, comprising:

(I) continuously feeding said wood as a feedstock to a receiving of a presoak container;

(II) injecting a weak acid solution into the receiving means to presoak the feedstock;

(III) continuously feeding the acid presoak feedstock under pressure from the receiving means to a first reactor loop of a tubular reactor;

(IV) injecting water into the tubular reactor countercurrently to said feedstock to form a slurry;

(V) continuously subjecting the slurry under pressure as it goes through several reactor loops in series;

(VI) heating each reactor loop with a first indirect heat exchanger to raise the temperature of the pressurized slurry therein to a temperature sufficient for hydrolysis of the slurry to occur;

(VII) cooling the pressurized slurry in each reactor loop with a second indirect heat exchanger to avoid the generation of vapour to ensure that the liquid portion of the slurry remains as a liquid;

(VIII) recovering heat from said second indirect heat exchanger and utilizing the heat recovered to supply at least part of the heat requirements of said first heat exchanger;

(IX) reducing with pressure reduction apparatus at an outlet of each reactor loop the pressure of the cooled slurry therein while maintaining the pressure in the reactor loop while the slurry is continuously discharged;

(X) separating the solid portion of the slurry using a separator;

(XI) recovering the solid portion containing lignin and passing it to the next reactor loop of the tubular reactor; and (XII) recovering the liquid portion of the slurry which is sugar rich acid-hydrolysate and injecting a part of the liquid portion to the preceding reactor loop of the tubular reactor.

2. A process as claimed in claim 1 wherein a third indirect heat exchanger is provided in each closed reactor loop to supplement the heat requirement of said first heat exchanger.

3. A process for the continuous hydrolysis of cellulose, comprising:

(I) continuously feeding said cellulose as a feed stock to a receiving means of a presoak container;

(II) injecting a weak acid solution into the receiving means to presoak the feedstock;

(III) continuously feeding the acid presoak feedstock under pressure from the receiving means to a first reactor loop of a tubular reactor;

(IV) injecting water into the tubular reactor countercurrently to said feedstock to form a slurry;

(V) continuously subjecting the slurry under pressure as it goes through several reactor loops in series;

(VI) heating each reactor loop with a first indirect heat exchanger to raise the temperature of the pressurized slurry therein to a temperature sufficient for hydrolysis of the slurry to occur; maintaining with its said first heat exchanger the temperature of the slurry in the process line for sufficient time for leaching of the slurry to occur;

(VII) cooling the pressurized slurry in each reactor loop with a second indirect heat exchanger to avoid the generation of vapour to ensure that the liquid portion of the slurry remains as a liquid;

(VII) recovering heat from said secnd indirect heat exchanger and u tilizing the heat recovered to supply at least part of the heat requirements of said first heat exchanger;

(VIII) reducing with pressure reduction apparatus at an outlet of each reactor loop the pressure of the cooled slurry therein while maintaining the pressure in the reactor loop while the slurry is continuously discharged;

(IX) separating the solid portion of the slurry using a separator;

(X) recovering the solid portion containing lignin and passing it to the next reactor loop of the tubular reactor; and (XI) recovering the liquid portion of the slurry which is sugar rich acid-hydrolysate and injecting a part of the liquid portion to the preceding reactor loop of the tubular reactor.

4. A process for the continuous hydrolysis of wood, comprising:

(I) continuously feeding said wood as a feedstock to a receiving means of a presoak container;

(II) injecting water into the receiving means to presoak the feedstock;

(III) continuously feeding the water presoak feedstock under pressure from the receiving means to a first reactor loop of a tubular reactor;

(IV) injecting additional water into the tubular reactor countercurrently to said feedstock to form a slurry;

(V) injecting a weak acid solution into the tubular reactor;

(VI) continuously subjecting the slurry under pressure as it goes through several reactor loops in series;

(VII) heating each reactor loop with a first indirect heat exchanger to raise the temperature of the pressurized slurry therein to a temperature sufficient for hydrolysis of the slurry to occur;

(VIII) cooling the pressurized slurry in each reactor loop with a second indirect heat exchanger to avoid the generation of vapour to ensure that the liquid portion of the slurry remains as a liquid;

(IX) recovering heat from said second indirect heat exchanger and utilizing the heat recovered to supply at least part of the heat requirements of said first heat exchanger;

(X) reducing with pressure reduction apparatus at an outlet of each reactor loop the pressure of the cooled sIurry therein while maintaining the pressure in the reactor loop while the slurry is continuously discharged;

(XII) separating the solid portion of the slurry using a separator;

(XII) recovering the solid portion containing lignin and passing it to the next reactor loop of the tubular reactor; and (XIII) recovering the liquid portion of the slurry which is sugar rich acid-hydrolysate and injecting a part of the liquid portion to the preceding reactor loop of the tubular reactor.

* * * * *